US008307619B2

(12) United States Patent
Strauss et al.

(10) Patent No.: US 8,307,619 B2
(45) Date of Patent: Nov. 13, 2012

(54) STIRRUP PAD

(75) Inventors: Isidore Strauss, Bridgewater, NJ (US); Tim Rafeld, Delaware, OH (US)

(73) Assignee: Intec Corporation, Cliffwood Beach, NJ (US)

( * ) Notice: Subject to any disclaimer, the term of this patent is extended or adjusted under 35 U.S.C. 154(b) by 534 days.

(21) Appl. No.: 12/640,395

(22) Filed: Dec. 17, 2009

(65) Prior Publication Data

US 2011/0146214 A1 Jun. 23, 2011

(51) Int. Cl.
*B68C 3/00* (2006.01)

(52) U.S. Cl. ..... 54/47

(58) Field of Classification Search ..... 54/47–49
See application file for complete search history.

(56) References Cited

U.S. PATENT DOCUMENTS

| | | | | |
|---|---|---|---|---|
| 3,905,179 | A | 9/1975 | Bischeltsrieder | |
| 5,172,538 | A | 12/1992 | Luger | |
| D339,665 | S | 9/1993 | Nishimoula | |
| 5,709,070 | A | 1/1998 | Peters | |
| 6,062,007 | A | 5/2000 | Cargill | |
| D458,420 | S | 6/2002 | Abady | |
| 6,425,230 | B2 | 7/2002 | Vollmecke et al. | |
| D461,602 | S | 8/2002 | Abady | |
| 7,073,313 | B1 | 7/2006 | Mullenbach | |
| 7,114,315 | B2 * | 10/2006 | Chang | 54/48 |
| 2009/0229146 | A1 * | 9/2009 | Yanke et al. | 36/131 |

* cited by examiner

*Primary Examiner* — Son T Nguyen
(74) *Attorney, Agent, or Firm* — King & Schickli, PLLC

(57) ABSTRACT

A stirrup pad for equitation includes a top member defining a surface for contacting at least a portion of a sole of a rider's foot or footwear and at least one side edge, and a rear member defining a surface for contacting at least a portion of a heel of the rider's foot or footwear. The rear member extends downwardly from the top member side edge. The top member is oriented along a first plane, and the rear member is oriented along a second plane which is substantially perpendicular to the first plane. A front member may be included, extending downwardly from the top member side edge. At least the front member and the rear member include flange elements for removably attaching the stirrup pad to a stirrup.

7 Claims, 4 Drawing Sheets

STIRRUP PAD

TECHNICAL FIELD

The present invention relates to a stirrup pad for use in equitation. In particular, the invention relates to a stirrup pad providing a gripping surface at a rear portion of a stirrup equipped with the pad, thereby providing an additional gripping surface for a heel of a rider's foot or footwear.

BACKGROUND OF THE INVENTION

The stirrup is an essential element of the rider's equipment in equitation sports. The stirrup, in conjunction with the saddle, provides a stable platform for the rider. Accordingly, the rider is better able to maintain balance in the saddle during equitation, and all-around comfort and safety are improved. With the use of the stirrup, the ability of the rider to stay mounted during the performance of various riding maneuvers is greatly enhanced, and the rider's confidence is thereby increased.

Conventional stirrups typically include a top portion which is secured to the saddle by a stirrup leather of known design. The conventional stirrup further includes a base or footpad attached to that top portion, for supporting the rider's foot or footwear. For rider comfort and to enhance gripping contact between the rider's footwear and the stirrup base portion, typically a pad fabricated of a suitably durable, resilient, and gripping material is provided, secured at least to the stirrup base portion.

In addition to enhancing gripping contact between the rider's footwear and the stirrup base portion, such stirrup pads provide a shock-dampening or shock-absorbing function, particularly during strenuous activities such as galloping, cantering, jumping, and the like. It is known to fabricate such pads of any number of suitably gripping and shock-absorbing materials, including rubber, plastics, various elastomers, and various polymers. The pads provide the afore-mentioned gripping and shock-absorbing or dampening properties, but are not significantly displaced by the rider's foot or footwear during use (relative to the stirrup base), providing a secure and stable platform for the rider's foot.

The conventional stirrup base portion pad provides contact only for the sole of the rider's footwear. However, this may be insufficient during very strenuous equitation, i.e., jumping, galloping, advanced dressage, and the like. Further, additional contact between the rider's foot or footwear and the stirrup pad may provide increased rider confidence. It would therefore be advantageous to provide a stirrup equipped with a stirrup pad providing additional gripping surfaces, such as for the rider's heel, to improve contact between the rider's foot or footwear and the stirrup pad.

In accordance with this need identified in the art, the present invention provides a stirrup having a top portion, a base portion connect to that top portion for supporting a rider's foot, and a stirrup pad secured to the base portion. The stirrup pad according to the present invention provides a substantially rigid, gripping surface at a rear portion of the stirrup base portion, thereby providing a gripping surface not only for contacting the sole of a rider's footwear, but also for contacting the heel. By use of the stirrup pad according to the present disclosure, contact between the rider's footwear and the stirrup during equitation is improved.

SUMMARY OF THE INVENTION

The above-mentioned and other problems become solved by applying the principles and teachings associated with the hereinafter-described stirrup pad. Broadly, the present disclosure provides stirrup pads including at least a top gripping surface for contacting at least a portion of a sole of a rider's foot or footwear, and a rear gripping surface for contacting at least a portion of a heel of a rider's foot or footwear. The described top and rear gripping surfaces provide suitable gripping properties and shock-absorbing properties as are known for stirrup pads.

In one aspect the present invention provides a stirrup pad for equitation, including a top member defining a surface for contacting at least a portion of a sole of a rider's foot or footwear and at least one side edge. The pad further includes a rear member defining a surface for contacting at least a portion of a heel of the rider's foot or footwear. That rear member extends downwardly from the top member side edge, that is, the top member is oriented along a first plane, and the rear member is oriented along a second plane which is substantially perpendicular to the first plane. The stirrup pad may further include a front member extending downwardly from the top member side edge.

In one embodiment, at least the front member and the rear member include flange elements for removably attaching the stirrup pad to a stirrup. The top member may also include flange elements depending downwardly from a bottom surface of the top member, also for removably engaging a stirrup. In one embodiment, at least the top member and the rear member define substantially planar surfaces. The top member, the rear member, the front member, and the flange elements may define a unitary body, or may be composed of separate elements attached one to the other.

In another aspect, there is provided a stirrup for equitation, including a top, substantially arcuate portion for connecting to a stirrup leather, a base connected to the arcuate portion for supporting a rider's foot, and a stirrup pad substantially as described above. The stirrup pad may be permanently or semi-permanently attached to the stirrup, but in one embodiment is conveniently configured as described above to be releasably attachable to the stirrup.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims. It should be appreciated that the embodiments shown and described herein are an illustration of one of the modes best suited to carry out the invention. It will be realized that the invention is capable of other different embodiments and its several details are capable of modification in various, obvious aspects all without departing from the invention. Accordingly, the drawings and descriptions will be regarded as illustrative in nature, and not as restrictive.

BRIEF DESCRIPTION OF THE DRAWING

The accompanying drawings incorporated in and forming a part of the specification, illustrates several aspects of the present invention, and together with the description serves to explain the principles of the invention. In the drawings.

Reference will now be made in detail to the best mode contemplated for carrying out the invention, examples of which are illustrated in the accompanying drawings. The examples are presented in support of and to further illustrate the invention as described herein. However, the invention is not to be considered as limited thereto.

DETAILED DESCRIPTION OF THE INVENTION

Figure 1:
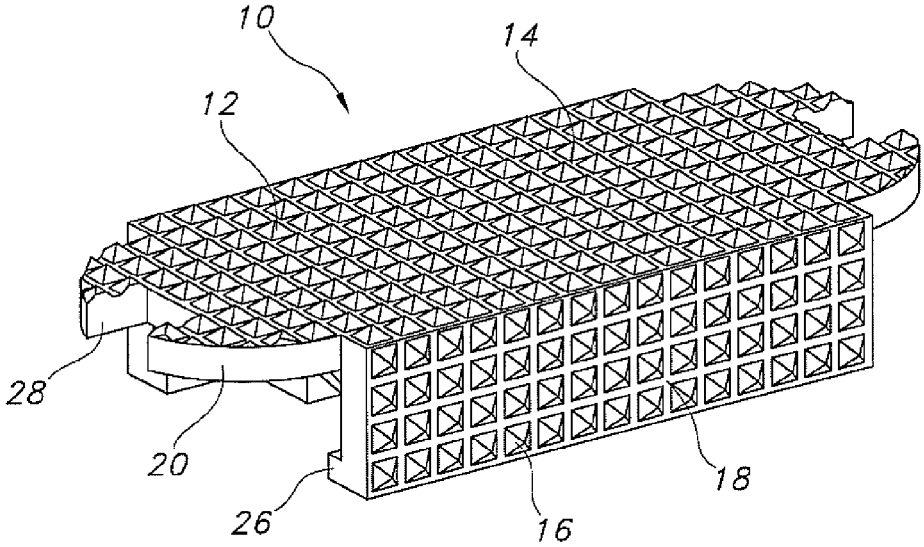
FIG. 1 is a rear perspective view of a stirrup pad according to the present invention.

In accordance with the need identified in the foregoing description, the present invention provides a stirrup pad 10 (see FIG. 1), including a top member 12 providing a surface 14 for contacting a portion of a rider's foot or footwear (not shown). The stirrup pad 10 further includes a rear member 16 providing a surface 18 for contacting a portion of a rider's heel. As shown in FIG. 1, rear 16 extends downwardly from top member 12, past a side edge 20 of top 12. In the depicted embodiments, the surfaces 14 and 18 are substantially planar, although it will be appreciated that arcuate or other alternatively shaped surfaces 14, 18 may be provided. Still further, the surfaces 14 and 18 may be provided with ridge features (un-numbered) or other suitable surface features for improving the gripping qualities of the surfaces, thereby improving the gripping contact between those surfaces 14, 18 and the rider's foot or footwear and reducing slippage.

Figure 2:
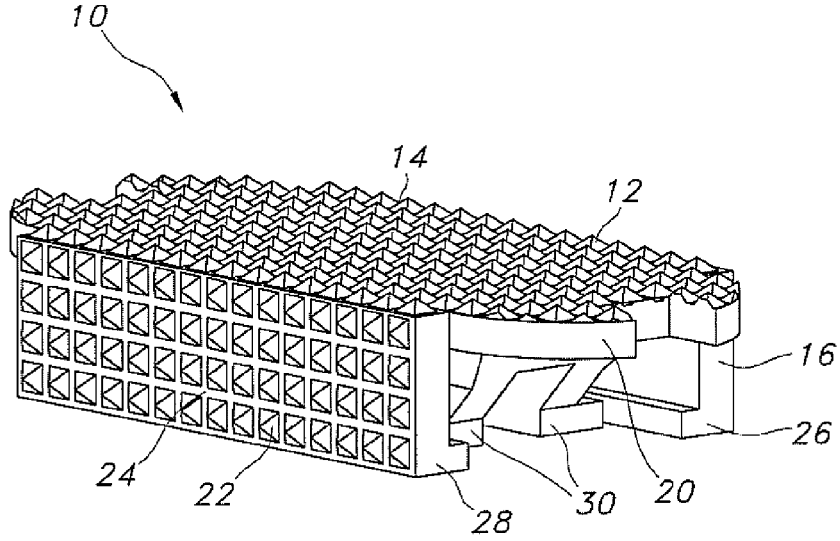
FIG. 2 is a front perspective view of the stirrup pad of FIG. 1.
Figure 3:
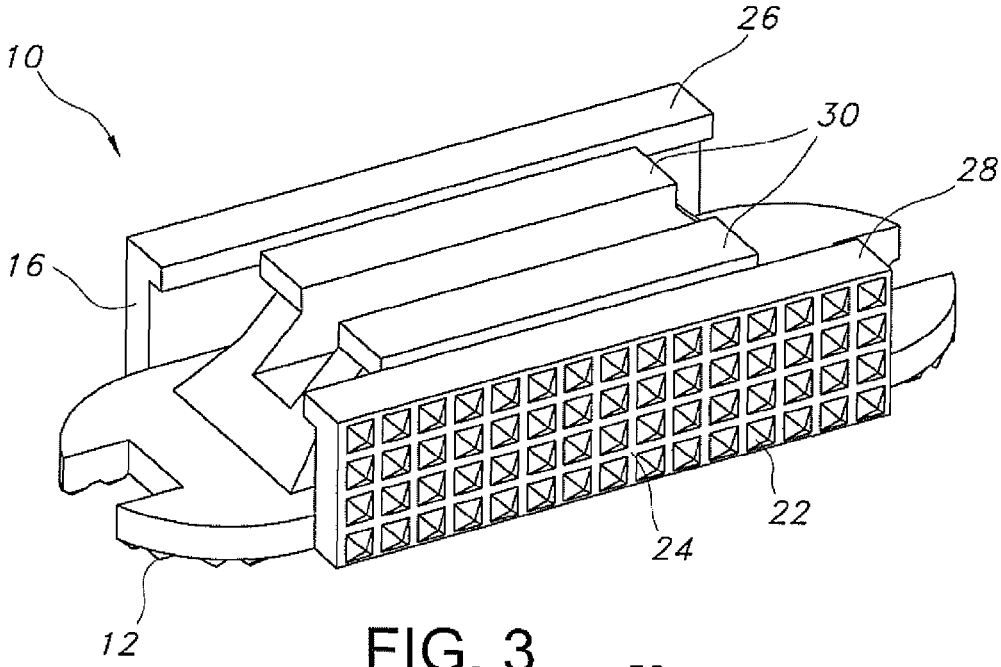
FIG. 3 shows a front perspective view of a bottom portion of the stirrup pad of FIG. 1.

Still further, as shown in FIG. 2 the stirrup pad 10 may be provided with a front member 22 defining a surface 24. The front member 22 and rear member 16 define a receiver for receiving a portion of a stirrup therein, as will be discussed below. Of course, the stirrup pad 10 may be secured to a stirrup in any desired manner, such as by use of adhesives, fasteners, and the like. However, desirably the stirrup pad 10 may be configured to releasably attach to a stirrup. For that reason, rear member 16 and front member 22 may be provided with flange elements 26, 28, respectively, for engaging a portion of a stirrup. Still further, top member 12 may be provided with one or more flange elements 30 (see FIG. 3) for engaging a portion of a stirrup.

Figure 4:
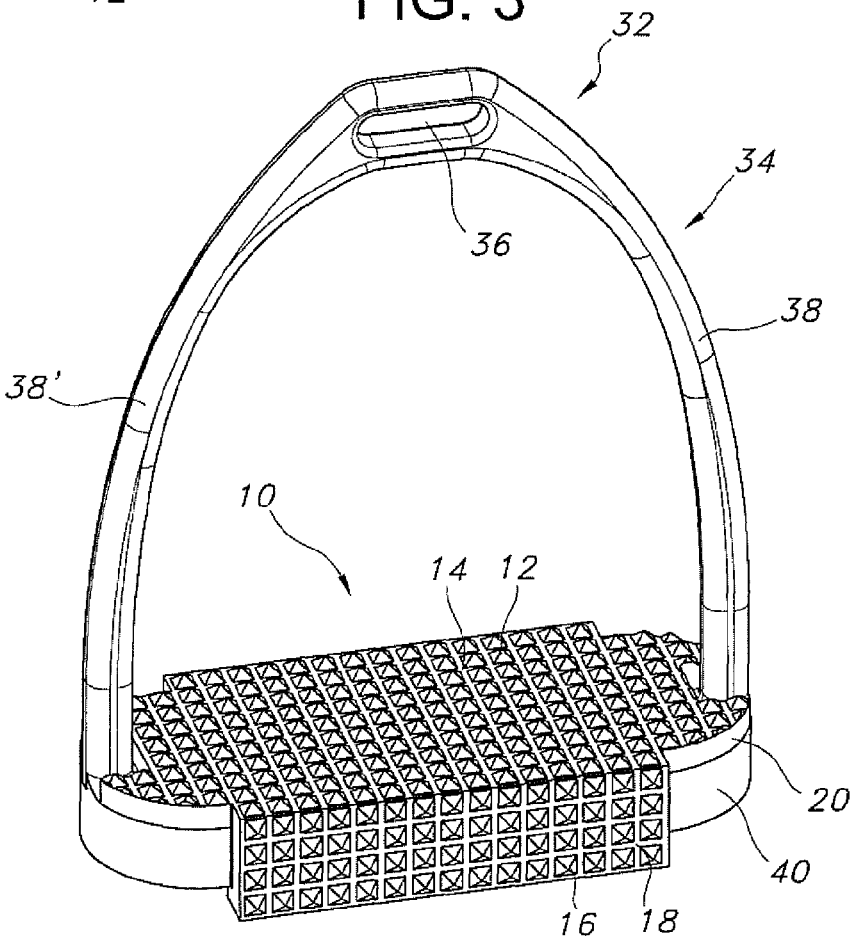
FIG. 4 shows the stirrup pad of FIG. 1 attached to a stirrup.

The stirrup pad 10 as described herein is shown in FIG. 4 attached to a stirrup 32 of substantially conventional configuration, including a substantially arcuate top portion 34 having a slot 36 at its apex for receiving a stirrup leather (not shown). Top portion 34 includes legs 38, 38' extending downwardly, and a substantially horizontal base or footpad 40 connecting legs 38, 38'.

Figure 5:
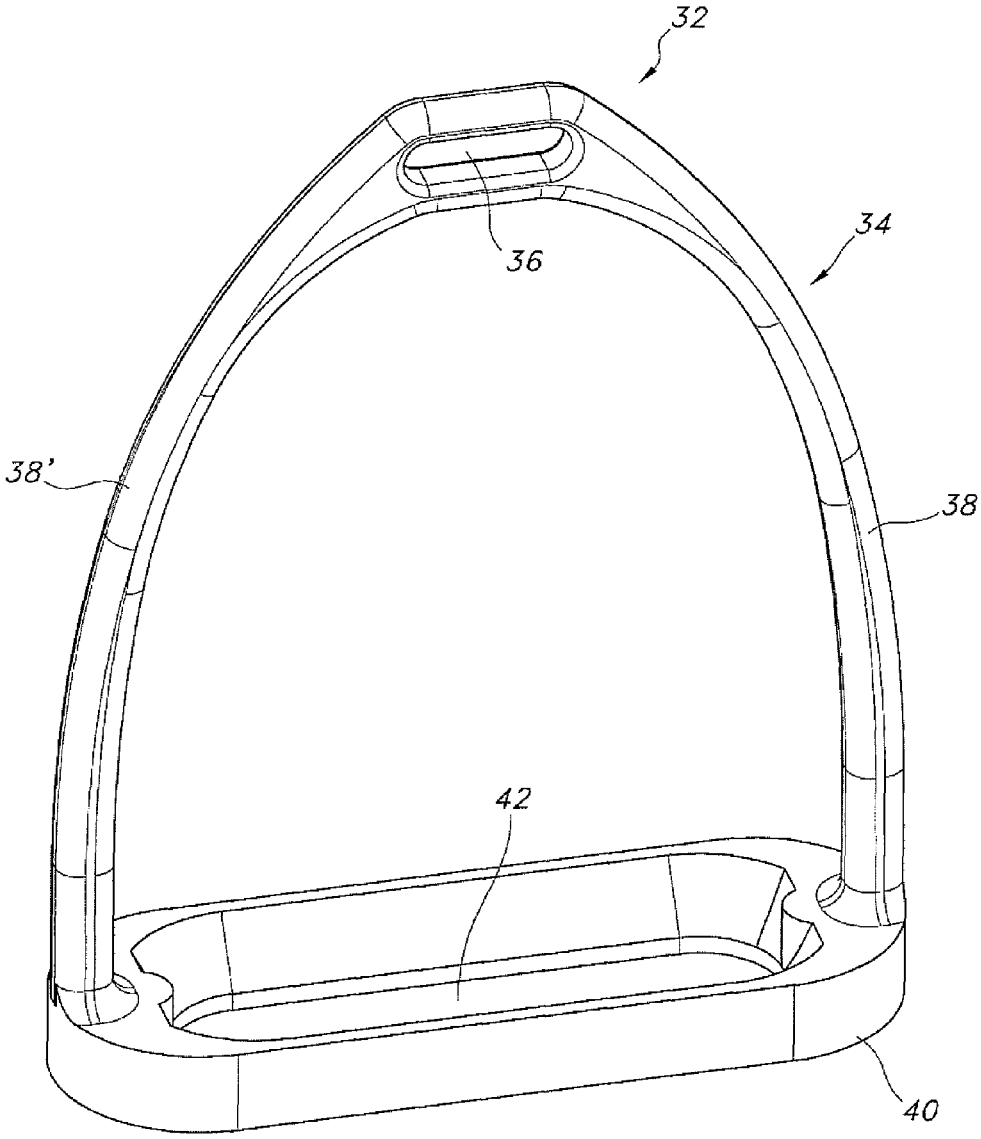
FIG. 5 shows a front perspective view of an alternative stirrup embodiment.
Figure 6:
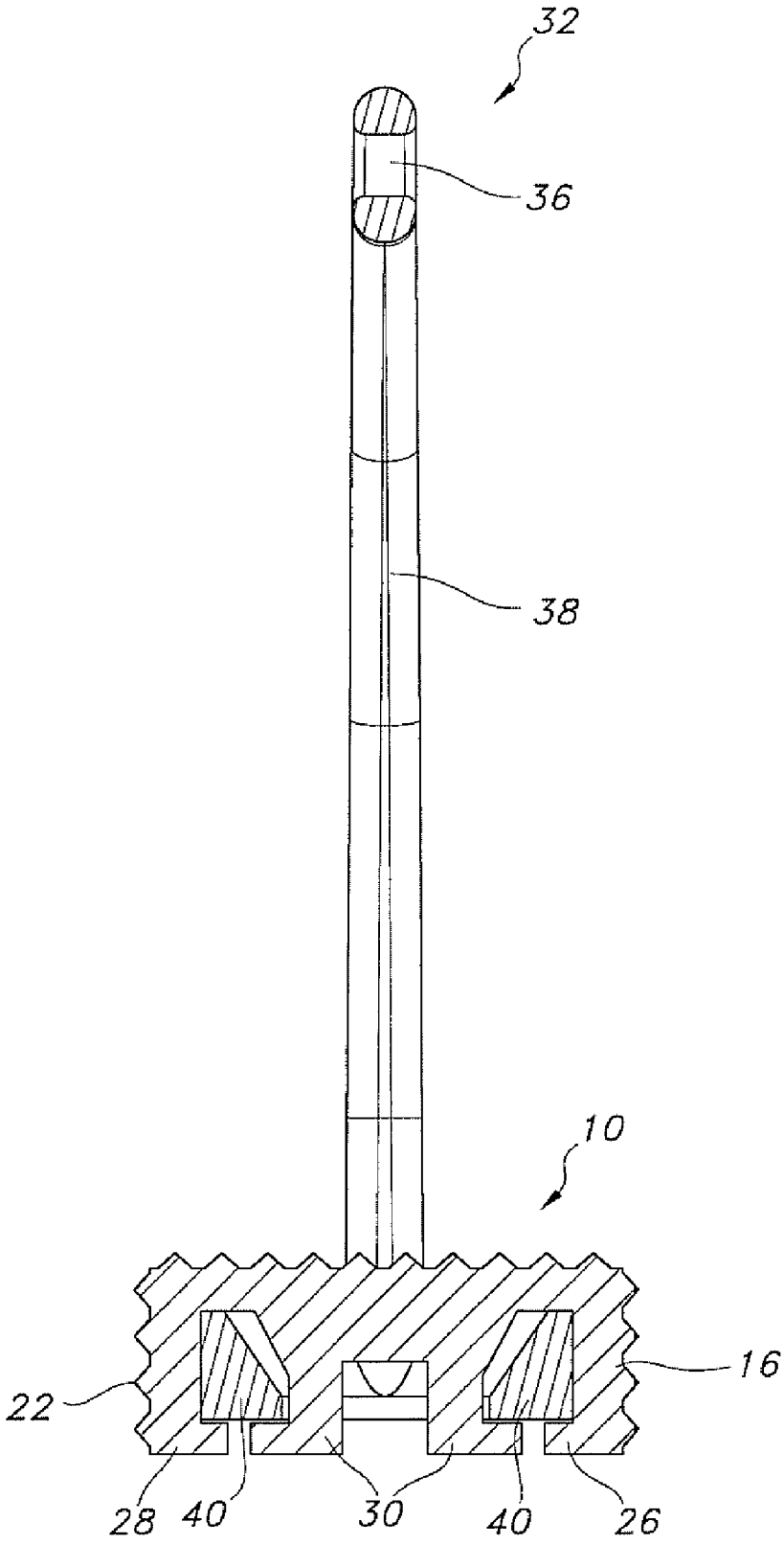
FIG. 6 is a cross-sectional side view of a stirrup according to the present invention attached to the stirrup of FIG. 5.

The stirrup pad 10 is shown attached to stirrup base 40 in FIG. 4. In one embodiment, front and rear member 16, 22 flanges 26, 28 engagingly receive stirrup base 40 therebetween, contacting at least a portion of a side surface and a portion of a bottom surface of stirrup base 40. In yet another embodiment, stirrup base 40 includes a slot 42 therethrough (see FIG. 5) through which top member 12 flange element 30 passes to also engage stirrup base 40, whereby at least a portion of an internal surface of slot 42 and at least a portion of a bottom surface of stirrup base 40 are contacted by flange element 30 (see FIG. 6). In that manner, stirrup pad 10 is releasably attached to stirrup 32, and may be easily removed by the user as needed, such as for cleaning or replacement.

The stirrup pad 10 of the present invention may be fabricated as a unitary body, or may include the above-listed elements as separate features fastened together, such as by suitable adhesives, fasteners, or both. For embodiments fabricated as a unitary body, the stirrup pad 10 may be fabricated by any suitable technique as is known in the art, such as injection molding and the like. Further, the stirrup pad 10 may be manufactured of any suitable material, including without limitation natural or synthetic rubbers, plastics, monomers, polymers, and elastomers, nylons, silicones, open and/or closed cell foams, gel materials including silicone gels, and/or combinations and composites thereof.

The skilled artisan will appreciate that the stirrup pad 10 according to the present disclosure provides a gripping surface which is not displaced by the rider's foot, not only for the sole of the rider's foot or footwear, but also for the heel. By providing such surfaces against which the rider's sole and heel may rest, gripping contact with the stirrup is improved, and also the rider's confidence during equestrian sports.

The foregoing description has been presented for purposes of illustration and description. It is not intended to be exhaustive or to limit the invention to the precise form disclosed. Obvious modifications or variations are possible in light of the above teachings. The described embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the foregoing description and appended claims, when interpreted in accordance with the breadth to which they are fairly, legally and equitably entitled.

What is claimed is:

1. A stirrup pad for equitation, comprising:

a top member defining a surface for contacting at least a portion of a sole of a rider's foot or footwear and at least one side edge; and a rear member defining a surface for contacting at least a portion of a heel of the rider's foot or footwear, wherein the rear member extends downwardly from the top member side edge;

further wherein the top member is oriented along a first plane, and the rear member is oriented along a second plane which is substantially perpendicular to the first plane; a front member extending downwardly from the top member side edge; wherein at least the front member and the rear member include flange elements for removably attaching the stirrup pad to a stirrup; wherein the top member includes flange elements depending downwardly from a bottom surface of said top member.

2. The stirrup pad of claim 1, wherein at least the top member and the rear member define substantially planar surfaces.

3. The stirrup pad of claim 1, wherein the top member, the rear member, the front member, and the flange elements define a unitary body.

4. A stirrup for equitation comprising the stirrup pad of claim 1.

5. A stirrup for equitation, comprising:

a substantially arcuate portion for connecting to a stirrup leather;

a base connected to the arcuate portion for supporting a rider's foot; and a stirrup pad engaging at least the base;

wherein the stirrup pad comprises a top member defining a surface for contacting at least a portion of a sole of a rider's foot or footwear and at least one side edge, and a rear member defining a surface for contacting at least a portion of a heel of the rider's foot or footwear;

further wherein the stirrup pad top member is oriented along a first plane, the rear member is oriented along a second plane which is substantially perpendicular to the first plane, and the rear member extends downwardly from the top member side edge; wherein the stirrup pad further includes a front member extending downwardly from the top member side edge whereby the stirrup pad defines a receiver for the stirrup base; wherein at least the stirrup pad front member and the stirrup pad rear member include flange elements for removably attaching the stirrup pad to a stirrup; wherein the stirrup pad top member includes flange elements depending downwardly from a bottom surface of said top member for engaging a slot in the stirrup base.

6. The stirrup of claim 5, wherein at least the stirrup pad top member and the stirrup pad rear member define substantially planar surfaces.

7. The stirrup of claim 5, wherein the stirrup pad top member, the stirrup pad rear member, the stirrup pad front member, and the stirrup pad flange elements define a unitary body.

* * * * *